US007686048B1

(12) United States Patent
Bradshaw

(10) Patent No.: US 7,686,048 B1
(45) **Date of Patent: *Mar. 30, 2010**

(54) METHOD AND APPARATUS FOR A GOLF CLUB HEAD COVER

(75) Inventor: Bruce A. Bradshaw, Clarion, IA (US)

(73) Assignee: Team Effort, Inc., Clarion, IA (US)

( * ) Notice: Subject to any disclaimer, the term of this patent is extended or adjusted under 35 U.S.C. 154(b) by 1107 days.

This patent is subject to a terminal disclaimer.

(21) Appl. No.: 11/334,839

(22) Filed: Jan. 19, 2006

Related U.S. Application Data

(63) Continuation-in-part of application No. 10/897,270, filed on Jul. 22, 2004, now Pat. No. 7,188,647, which is a continuation of application No. 10/136,004, filed on Apr. 30, 2002, now Pat. No. 6,820,665, which is a continuation-in-part of application No. 10/056,355, filed on Jan. 24, 2002, now abandoned.

(51) Int. Cl.
*A63B 57/00* (2006.01)

(52) U.S. Cl. ..... 150/160; 206/315.2; 206/315.4

(58) Field of Classification Search ..... 150/159, 150/160; 206/315.2, 315.4; D21/754
See application file for complete search history.

(56) References Cited

U.S. PATENT DOCUMENTS

| | | | | |
|---|---|---|---|---|
| 2,035,529 | A | | 3/1936 | Bucklin |
| 2,508,515 | A | | 5/1950 | Fevre |
| 2,526,985 | A | | 10/1950 | Whitehead |
| 2,532,195 | A | | 11/1950 | Rosenow et al. |
| 2,705,039 | A | | 3/1955 | Halter |
| 3,023,795 | A | | 3/1962 | Denkert |
| 3,072,167 | A | | 1/1963 | Banas |
| 3,117,609 | A | | 1/1964 | Pio |
| 3,133,577 | A | * | 5/1964 | Bellevue, Sr. ..... 150/160 |
| D202,200 | S | * | 9/1965 | Bates ..... D21/754 |
| 3,303,865 | A | | 2/1967 | Ouimet |
| 3,478,799 | A | | 11/1969 | Hoyt, Jr. |
| 3,574,963 | A | | 4/1971 | Rosenow |
| 3,613,760 | A | | 10/1971 | Koehnle |
| 3,727,659 | A | | 4/1973 | Shuford |

(Continued)

FOREIGN PATENT DOCUMENTS

| | | |
|---|---|---|
| GB | 1 360 058 | 7/1974 |

*Primary Examiner*—Sue A Weaver
(74) *Attorney, Agent, or Firm*—McKee, Voorhees & Sease, P.L.C.

(57) ABSTRACT

A golf club head cover and method of using is disclosed. The golf club head cover includes a body having an upper portion and a lower portion, the upper portion adapted for protecting the head of the club, the lower portion operatively connected to the upper portion for protecting at least a portion of the shaft of the club, the lower portion having an open collar. The golf club head cover can include an identifier that identifies a size of the golf club head cover. The present invention also includes a method of using the golf club head cover. The method includes providing a golf club head cover having a body with an upper portion and a lower portion, inserting a golf club head into the upper portion, and pressing the hosel or shaft of the club into the lower portion to secure the golf club head cover to the club.

19 Claims, 8 Drawing Sheets

U.S. PATENT DOCUMENTS

| | | | | | |
|---|---|---|---|---|---|
| 3,821,976 | A | | 7/1974 | Smith et al. | |
| 3,892,267 | A | | 7/1975 | Bibeau | |
| 4,213,614 | A | | 7/1980 | Philippi | |
| 4,378,832 | A | | 4/1983 | Thompson | |
| 4,667,716 | A | * | 5/1987 | Solheim et al. | 150/160 |
| 4,898,222 | A | | 2/1990 | Gaffney | |
| 4,971,126 | A | * | 11/1990 | Borenstein | 150/160 |
| 5,117,884 | A | | 6/1992 | Diener et al. | |
| 5,284,194 | A | | 2/1994 | Gaffney | |
| 5,297,603 | A | | 3/1994 | Meek | |
| 5,345,987 | A | * | 9/1994 | Hagar | 150/160 |
| 5,403,009 | A | * | 4/1995 | Gleason, Jr. | 473/256 |
| 5,415,213 | A | | 5/1995 | Diener et al. | |
| D362,890 | S | | 10/1995 | Sheppard | |
| 5,547,193 | A | | 8/1996 | Sander | |
| D374,051 | S | | 9/1996 | Sheppard, Jr. | |
| 5,615,720 | A | * | 4/1997 | O'Sullivan | 150/160 |
| 5,738,157 | A | | 4/1998 | Gaffney | |
| 5,944,081 | A | | 8/1999 | Aldcroft et al. | |
| D421,780 | S | * | 3/2000 | Whitesides | D21/754 |
| D421,781 | S | | 3/2000 | Somers | |
| 6,044,880 | A | * | 4/2000 | Maeng | 150/160 |
| D432,193 | S | | 10/2000 | Bradshaw | |
| 6,230,886 | B1 | | 5/2001 | Bradshaw | |
| 6,321,805 | B1 | * | 11/2001 | Suggs | 150/160 |
| 6,374,882 | B1 | * | 4/2002 | McLoughlin | 150/160 |
| D457,584 | S | * | 5/2002 | Butler | D21/754 |
| 6,820,665 | B2 | | 11/2004 | Bradshaw | |
| 2002/0124920 | A1 | * | 9/2002 | Noyes | 150/160 |

* cited by examiner

METHOD AND APPARATUS FOR A GOLF CLUB HEAD COVER

CROSS-REFERENCE TO RELATED APPLICATIONS

This application is a Continuation-in-part of patent application U.S. Ser. No. 10/897,270 filed Jul. 22, 2004, and issued as U.S. Pat. No. 7,188,647, which is a Continuation of patent application U.S. Ser. No. 10/136,004 filed Apr. 30, 2002, and issued as U.S. Pat. No. 6,820,665, which is a Continuation-in-part of patent application U.S. Ser. No. 10/056,355 filed on Jan. 24, 2002, now abandoned, all of which are herein incorporated by reference in their entirety.

BACKGROUND OF THE INVENTION

The present invention relates generally to the field of golf accessories. More particularly, but not exclusively, the present invention relates to an improved golf club head cover and methods of using the golf club head cover.

Golf club head covers have been widely used for some time to protect the heads of golf clubs. Using the cover protects a golf club head from marring, scratching or other damage often caused by contact with other clubs or club heads. The cover can also protect at least a portion of the golf club shaft from similar damage.

One problem with club head covers is that they tend not to stay secured to the club head and/or shaft. When a club head cover fails to maintain its position secured to a club head or shaft, it does not serve its intended function, as it is no longer protecting the club head. Some prior art head covers are susceptible to being undone, allowing the club head cover to become dislodged.

A further problem with golf club head covers is the amount of effort required to secure the head cover around the golf club when storing, as well as the time required to remove the golf club head cover when using the club. Prior art golf club head covers generally require some additional effort to both secure and unsecure the head cover from the golf club. If the amount of effort becomes too much, it is likely that the golfer will simply not use the head cover, particularly during a round of golf. Of course, if the head cover is not being used, then it can not fulfill its intended purpose of protecting the golf club head.

Yet another problem with golf club head covers has been created due to the number of different type of clubs now available. The sizes of golf club heads no longer follow any generalized rules. For example, many clubs are oversized. Thus, a head cover that is identified as appropriate for a driver, may not actually fit all drivers that are available given the varying sizes. Thus, a golfer may not be able to determine what size of golf club head cover to get for a club without trying various sizes. Although a one-size-fits-all golf club head cover could be used, such a golf club head cover is likely to have at least some of the deficiencies previously discussed. Thus, there are problems in identifying what golf club head cover to use with what club.

Therefore, problems remain in the art, and there exists a need in the art for an improved golf club head cover.

A general object, feature, or advantage of the present invention is the provision of an improved golf club head cover and methods of using the golf club head cover that overcome the problems and deficiencies found in the prior art.

Another object, feature, or advantage of the present invention is the provision of a golf club head cover and methods of using the golf club head cover to protect a golf club head from marring and scratching.

Another object, feature, or advantage of the present invention is the provision of a golf club head cover and methods of using the golf club head cover that also protect at least a portion of the golf shaft from damage.

Yet another object, feature, or advantage of the present invention is the provision of a golf club head cover that is easily and quickly secured to a golf club.

A still further object, feature, or advantage of the present invention is the provision of a golf club head cover that is resistant to becoming accidentally unsecured.

A still further object, feature, or advantage of the present invention is the provision of a golf club head cover that is durable in use and economical to manufacture.

Another object, feature, or advantage of the present invention is a golf club head cover that readily allows a golfer to determine if the golf club head cover will fit a particular club.

These as well as other objects, features and/or advantages of the present invention become apparent from the following specification and claims.

SUMMARY OF THE INVENTION

The golf club head cover of the present invention includes a protective cover that can be easily secured to and removed from a golf club. The golf club head cover is not prone to becoming accidentally unsecured. According to one aspect of the present invention, the golf club head cover includes a body having an upper portion and a lower portion, the upper portion adapted for covering the head of the club and the lower portion for protecting a portion of the shaft of the club, the lower portion having an open collar.

According to another aspect of the invention, a method of protecting a golf club includes providing a golf club head cover having a body with an upper portion and a lower portion, inserting the golf club head into the upper portion, and pressing the hosel or shaft of the club into the lower portion to secure the golf club head cover to the club. This aspect of the invention allows the golf club head to be protected in a convenient manner.

Another aspect of the present invention provides for protecting a head of a golf club. The cover includes a body having an upper portion and a lower portion, the upper portion adapted for protecting the head of the club, the lower portion adapted for protecting at least a portion of the hosel or shaft of the club, and the lower portion having spaced apart sidewalls. This structure for the golf club head cover allows the cover to be quickly and conveniently secured to the club head.

A further aspect of the present invention provides for attaching an identifier to the body of a golf club head cover. The identifier indicates a size of the golf club head cover and can be independent of the type of club used. The identifier provides a convenient method of determining whether a particular head cover will fit a particular club.

DETAILED DESCRIPTION OF THE PREFERRED EMBODIMENTS

Figure 1:
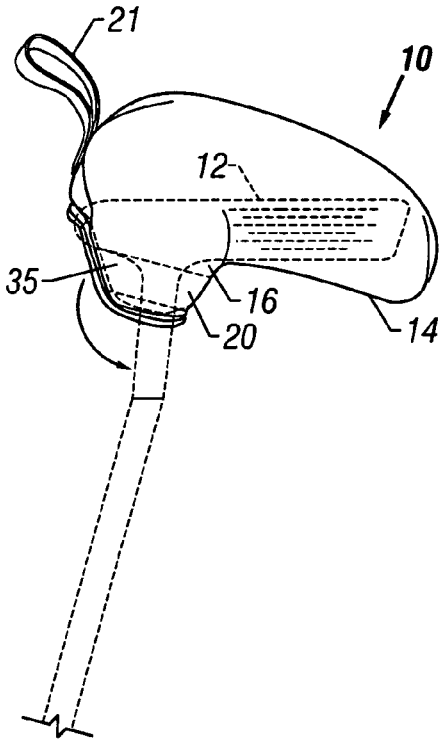
FIG. 1 is a side elevational view of the golf club head cover.

The present invention will now be described as it applies to its preferred embodiments. It is not intended that the present invention as claimed be limited to the described embodiments or equivalents thereof. It is intended that the invention cover all modifications and alternatives which may be included within the spirit and scope of the invention.

FIGS. 1-5 of the drawings shows one embodiment of the golf club head cover 10, which is intended for use with a putter 12 (shown in dashed lines). The golf club head cover 10 includes an upper portion 14 which is in the form of a protective pocket or cavity adapted to fit the head of the putter 12. The golf club head cover 10 also includes a lower portion 16. The lower portion 16 is adapted to fit around a portion of the hosel or shaft of the putter 12. The lower portion 16 may be a collar. The lower portion or collar 16 is an open collar adjacent to the upper portion 14 that allows the putter head to be inserted into the golf club head cover 10 (see FIG. 1). The golf club head cover 10 also includes a lining 18 (see FIG. 5). The present invention contemplates that the golf club head cover 10, as well as the lining 18, may be made from a variety of materials, including leather, fabric, padding, and other materials. Methods of construction are well known in the art.

Figure 2:
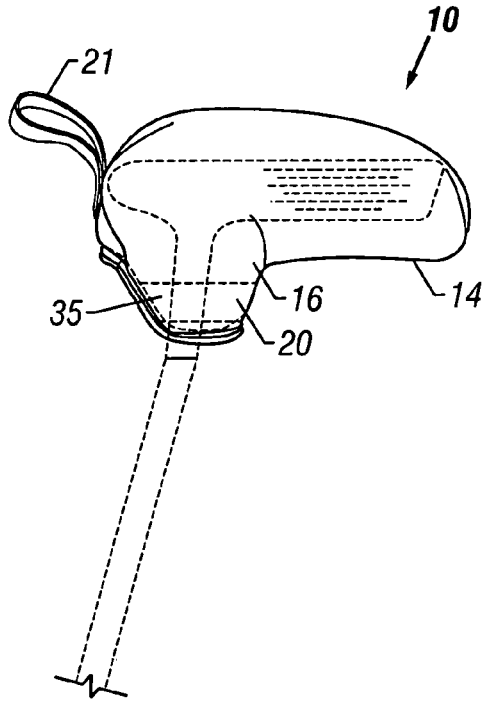
FIG. 2 is another side elevational view of the golf club head cover.

As shown in FIGS. 1 and 2, the golf club head cover 10 also includes a fastener to secure the golf club head cover 10 to the club. The present invention contemplates that numerous types of fasteners can be used. For example, clips, snaps, clasps, hook and loop type fasteners such as VELCRO, and other types of fasteners can be used. Shown in FIG. 1 is a clip 20. The clip 20 is disposed about the lower portion 16 of the golf club head cover 10. The clip 20 is preferably a resilient, c-shaped clip that is partially open with inverted ends, such as the clip shown in FIGS. 3 and 4. The clip 20 allows the golf club head cover 10 to fit around a golf club head and then to be secured to the hosel or shaft of the golf club by the clip 20. The clip 20 may be made from a variety of different materials, including metals, hard plastics or other resilient materials capable of receiving the hosel or shaft of the golf club and maintaining the golf club head cover in a secured position.

The clip 20 is preferably disposed within the interior lining 18 of the golf club head cover 10, although the clip need not be placed in the lining nor the interior of the golf club head cover. When placed within the interior lining 18 of the golf club head cover 10, the clip 20 cannot damage the shaft or club head of the golf club. The present invention, however, also contemplates that the clip 20 or other fastener need not be located in the interior lining, provided that it is attached to the lower portion 16 or collar of the golf club head cover 10. The purpose of this or other fasteners is to secure the golf club head cover to the shaft, thus the fasteners can be of different varieties and can be located in different positions based upon the specific size and shape of the golf club head cover and type of fastener used.

Figure 3:
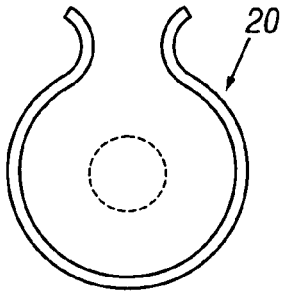
FIG. 3 is a top elevational view of a clip for use with the golf club head cover.
Figure 4:
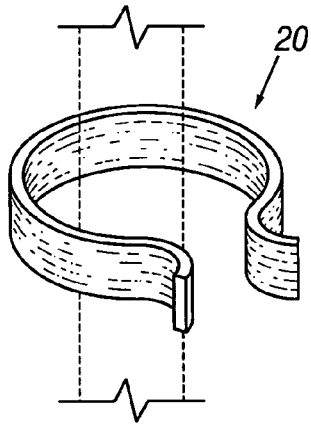
FIG. 4 is a perspective view of the clip shown in FIG. 3.
Figure 5:
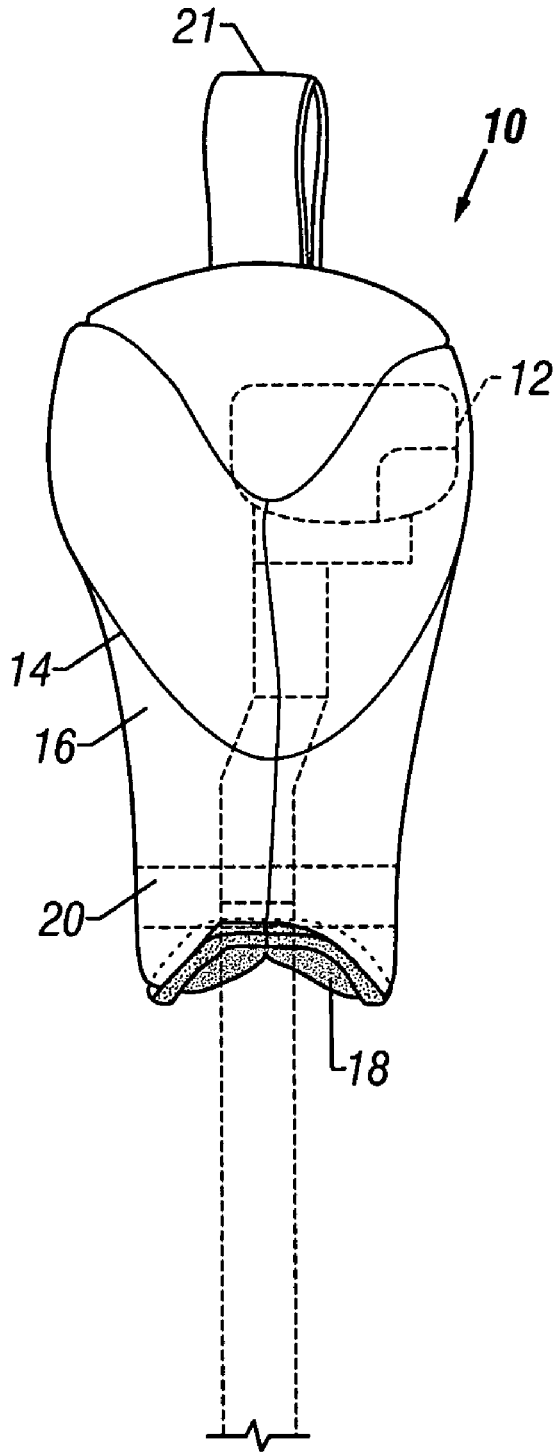
FIG. 5 is a front elevational view of the golf club head cover.

FIGS. 3 and 4 illustrate one embodiment of the resilient, c-shaped clip 20. As shown in the figures, the clip 20 is adapted to receive the shaft of the putter 12 in order to secure the golf club head cover 10. The shape of the clip 20 shown allows a golfer to easily clip the golf club head cover 10 to the shaft and to easily unclip the golf club head cover 10 from the shaft. At the same time, however, the shape of the clip 20 also serves to retain or secure the golf club head cover 10 in position. It should be understood that the present invention is not limited to clips let alone any particular shape or size of clip. The clip 20 shown in FIGS. 3 and 4 is exemplary only.

One intended use of the golf club head cover 10 is illustrated in FIGS. 1 and 2. As shown in FIG. 1, the head of the putter 12 is first inserted into the cavity formed by the upper portion 14 of the protective cover of the golf head cover 10. The golf head cover 10 is then rotated so that the lower portion 16 of the protective cover moves toward the shaft of the putter 12 until the clip 20 is secured about the shaft (see FIG. 2). To remove the golf club head cover 20, the golfer simply pulls up on the pull tab 21, which is sewn or otherwise connected to the protective cover.

Figure 8:
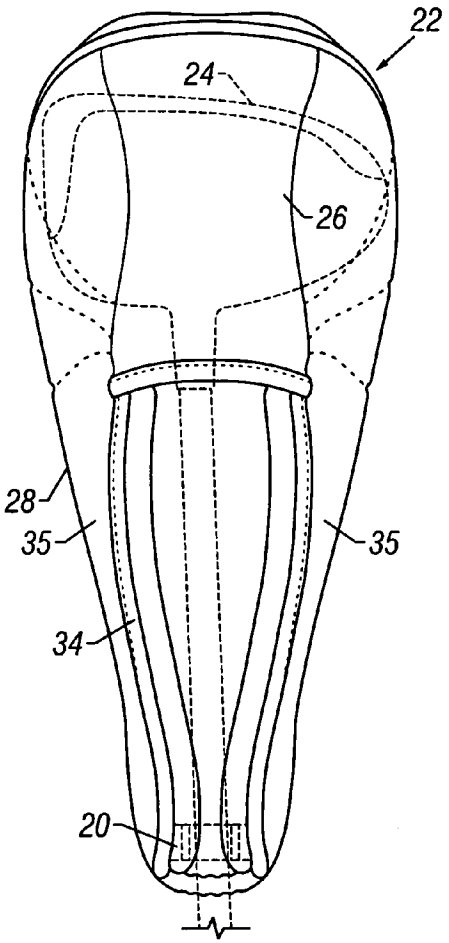
FIG. 8 is a front elevational view of the golf club head cover of FIG. 6.
Figure 7:
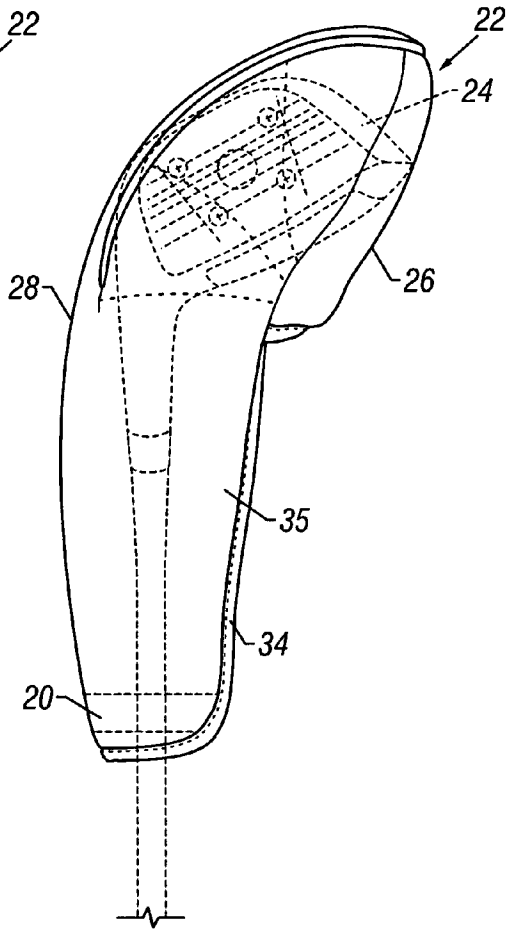
FIG. 7 is another side elevational view of the golf club head cover of FIG. 6.
Figure 6:
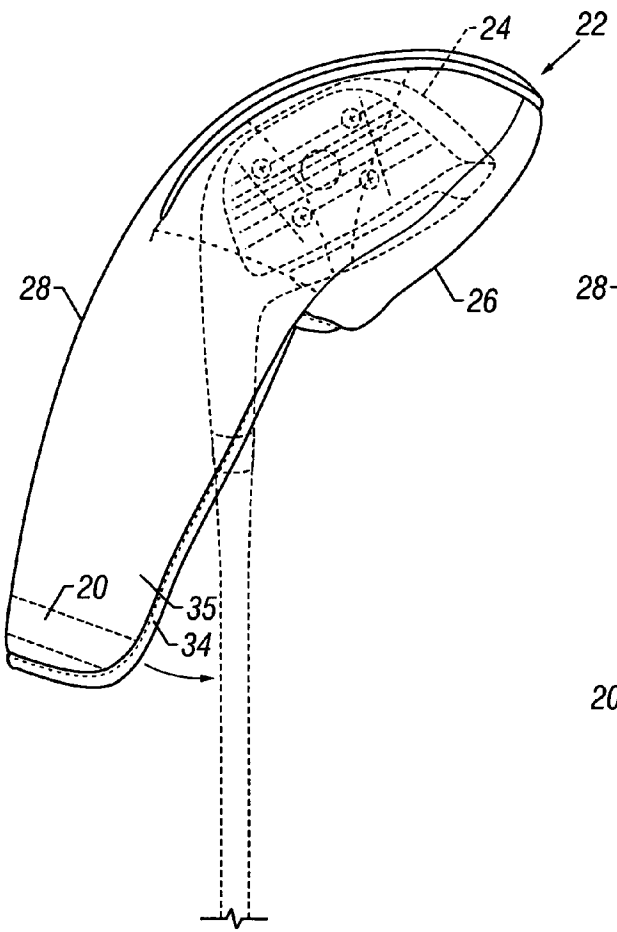
FIG. 6 is a side elevational view of an alternative embodiment of the golf club head cover.

The present invention contemplates that the golf club head cover may be of various sizes and may be shaped to fit a variety of clubs, including putters, irons and woods, all of various sizes. For example, an alternative embodiment of the invention intended for use with a wood or metal driving club is shown in FIGS. 6-8. The golf club head cover 22 shown in FIG. 6 includes a protective cover having an upper portion 26 shaped to fit around a club head of the golf club 24. The protective cover also includes a lower portion 28 that includes the same resilient clip 20 (shown in dotted lines) or other fastener. The lining of the golf club head cover 22 is denoted by reference numeral 30. The lower portion 28 of the protective cover extends away from the upper portion 26 a sufficient distance to partially surround at least a portion of the shaft of the golf club.

FIGS. 6 and 7 again illustrate the intended use of the golf club head cover 22. As described previously, once the club head is inserted into the cavity of the upper portion 26, the lower portion 28 is rotated towards the shaft until the clip 20 is secured about the shaft of the golf club. The lower portion 28 includes spaced apart sidewalls 35 that form an open collar 34. The spaced apart sidewalls 35 taper downward. The widest portion of the collar is suitable for accepting the club head of a wood that is inserted. This allows the club head cover 22 to be easily fitted to a club and easily removed. The golf club head cover 22 is removed by simply pulling the lower portion 28 of the protective cover away from the shaft.

Figure 8A:
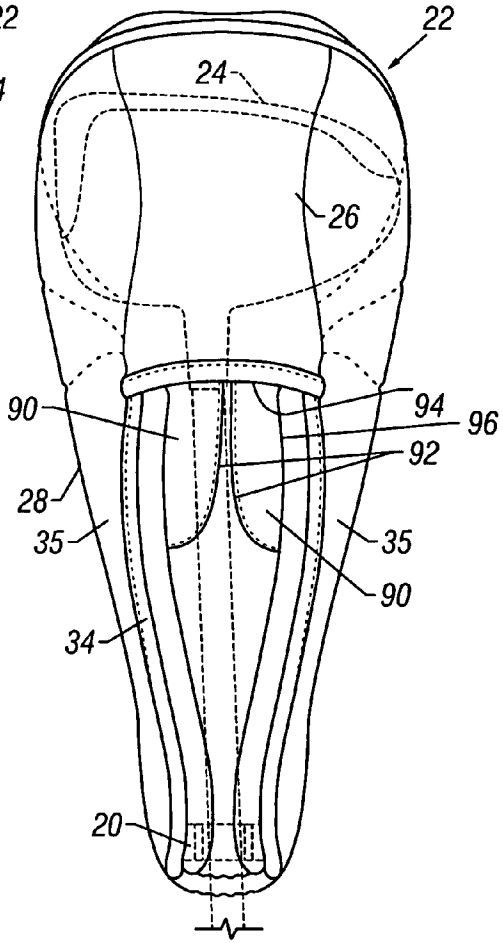
FIG. 8A is a front elevational view of the golf club head cover of FIG. 6A.
Figure 7A:
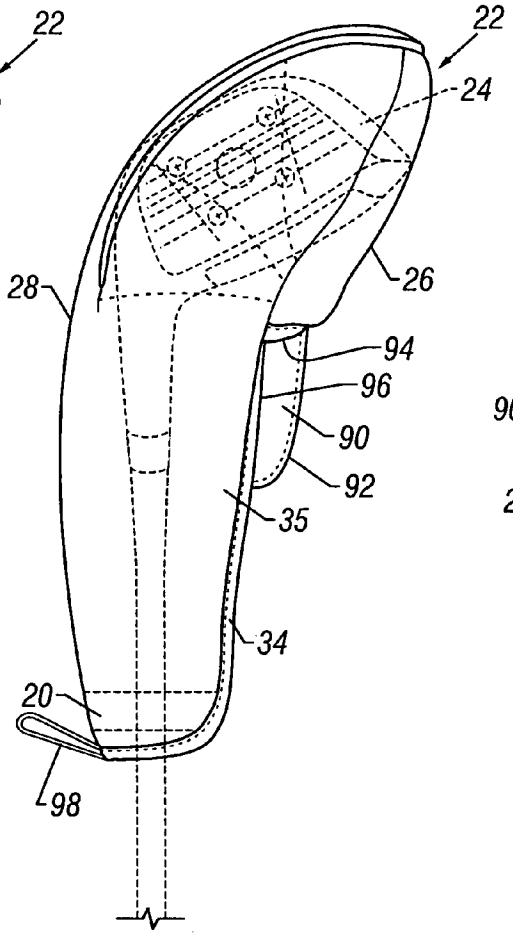
FIG. 7A is another side elevational view of the golf club head cover of FIG. 6A.
Figure 6A:
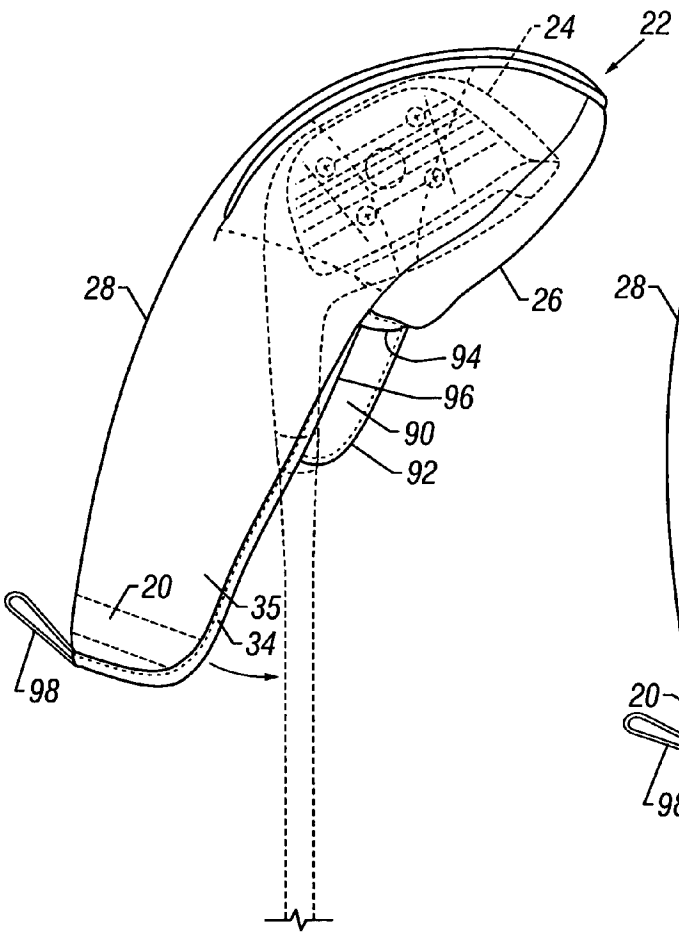
FIG. 6A is a side elevational view of another embodiment of the golf club head cover.

As best shown in FIGS. 6A, 7A and 8A, the golf club head cover 22 can additionally have one or more flaps 90. The edge of the flaps 92 may be rounded or padded to protect a golf club head, which is inserted into the cover 22. The design of cover 22, as shown in FIGS. 6A, 7A and 8A are similar to those shown in FIGS. 6-8 and are used similarly to those shown in FIGS. 6-8. The flaps 90 have a top portion 94 which attaches to a top portion of the collar 34 at the upper portion 26 of the cover 22. Similarly, the flaps 90 have a side portion 96 which attaches to the collar 34 along the sidewalls 35. Preferably, the flaps 90 are constructed from a flexible material or other covering to allow the flaps 90 to flex open while the golf club head 24 is inserted into the cover 22. Then, once the golf club 24 is inserted into the cover 22, the flaps 90 can flex back to their original position, as shown in FIG. 8A, thereby giving additional protection to the shaft of the golf club 24. The flaps 90 can be stitched or otherwise held to the cover. Additionally, the flaps 90 can be integrally formed from the upper portion 26 or the sidewalls 35.

FIGS. 6A, 7A and 8A additionally show a tab 98, which is similar to the tab 21 and the tab 32 shown in other figures. The tab 98 helps in the removal of the cover 22 from the golf club 24. The tab 98 may or may not be used with the present invention.

It can be appreciated that one difference between the two embodiments shown is the position of the lower portions (16, 28) and clip 20 relative to the shaft of the golf club (12, 24). In the first embodiment intended for use with a putter, the opening to the cavity in the golf club head cover is at the rear of the head cover; whereas, in the second embodiment, intended for wood and metal driving clubs, the opening to the cavity is disposed toward the front of the head cover.

Figure 9:
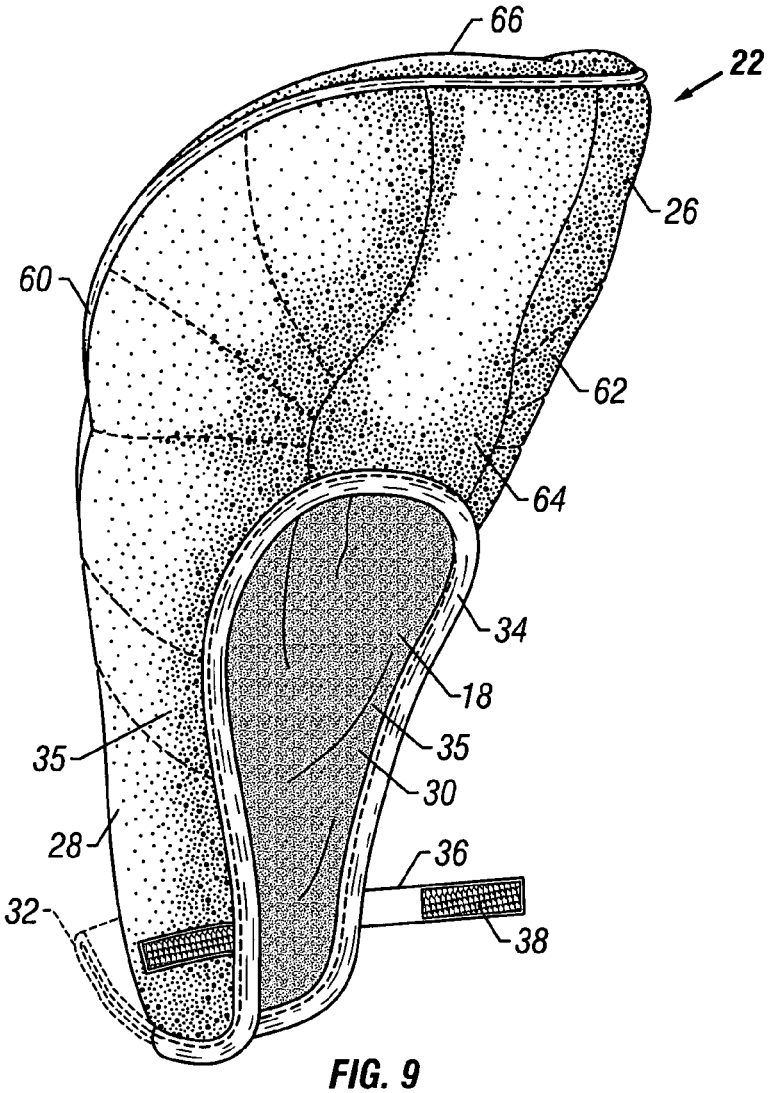
FIG. 9 is a perspective view of one embodiment of the present invention where an outside fastener is used.

Another embodiment of the present invention is shown in FIG. 9. The golf club head cover 22 includes a tab 32 attached to the lower portion 28 of the body of the golf club head cover. The pull tab 32 is preferably positioned adjacent to or opposite the fastener such that the tab 32 can be pulled to unfasten the golf club head cover from the shaft or hosel of the golf club. This allows the golf club head cover to be easily and conveniently removed, or at least unfastened from the golf club. A hook and loop type fastener 38 such as VELCRO is also shown. At least a portion of the fastener may be mounted to the outside of the golf club head cover 22 as shown.

Figure 10:
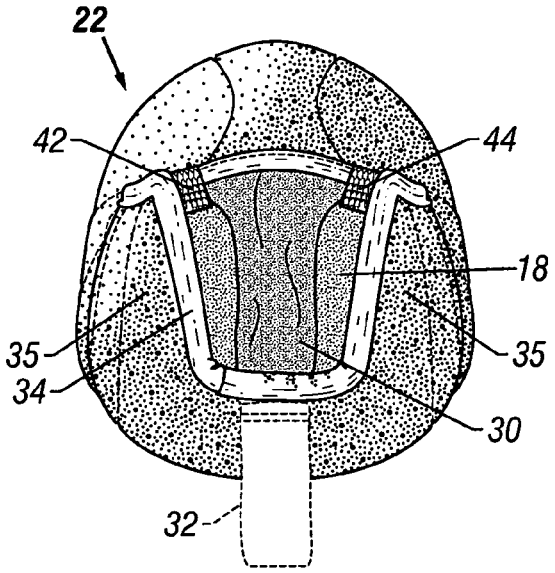
FIG. 10 is a perspective view of another embodiment of the present invention where an inside fastener is used.

As shown in FIG. 9, the integral body of the golf club head cover 22 is formed from a back wall portion 66, a front wall portion 64 and first and second opposite side wall portions 60 and 62. The first and second opposite side wall portions 60 and 62 extend downwardly from the front wall portion 64 to form an open collar 34 below the front wall portion 64. Alternatively, as shown in FIG. 10, all, or a portion of the fastener may be mounted on the inside of the golf club head cover, where fastener portions 42 and 44 can be pressed together in order to matingly connect the opposite sidewalls of the lower portion of the golf club head cover. Preferably, to remove the golf club head cover 22 from a club, a golfer can simply pull the tab 32. However, the present invention also contemplates that a fastener may also require being separately unfastened prior to removal of the head cover 22, depending upon the type of fastener used.

Figure 11:
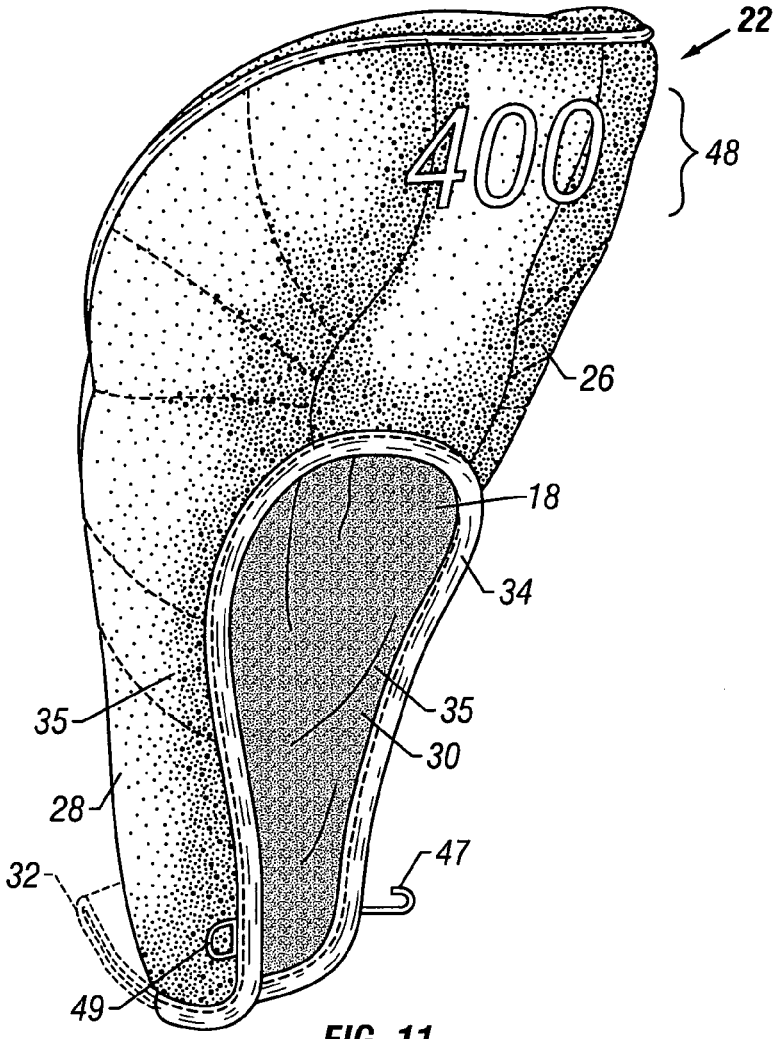
FIG. 11 is a perspective view of another embodiment of the present invention.
Figure 12:
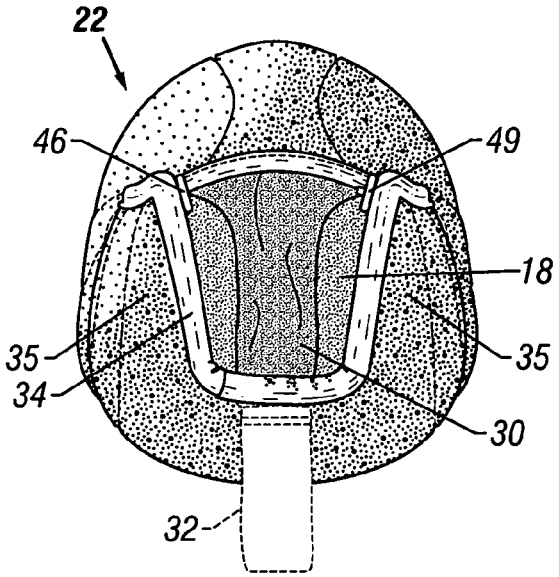
FIG. 12 is a perspective view of another embodiment of the present invention where a snap fastener is used.

FIG. 11 shows another embodiment of the present invention. In FIG. 11, a hook 47 and ring 49 form a fastener in order to secure the golf club head cover 22 to a shaft of a club. In FIG. 12, a fastener is shown with snap portions 46 and 49 for securing the golf club head cover 22 to a shaft of the club. The present invention contemplates that other types of fasteners can also be used, and is in no way limited to the particular types of fasteners shown.

Returning to FIG. 11, there is an identifier 48 shown on the body of the golf club head cover 22. The identifier 48 can be used to indicate a size of a particular golf club head cover as opposed to the type of golf club to be used with the head cover. One convenient identifier is to associate the identifier with a volume of the golf club head cover. For example, an identifier of "400" can be used to indicate that the golf club head cover is sized to cover approximately 400 cubic centimeters. The present invention contemplates that other measurement systems can be used. One importance of the identifier is that the identifier can be based on size and is independent of the type of golf club used.

The identifier is attached to the body in any number of ways. For example, the identifier can be sewn or stitched, secured with an adhesive, tied or otherwise attached. The present invention is in no way limited to the particular manner of attachment.

Figure 13:
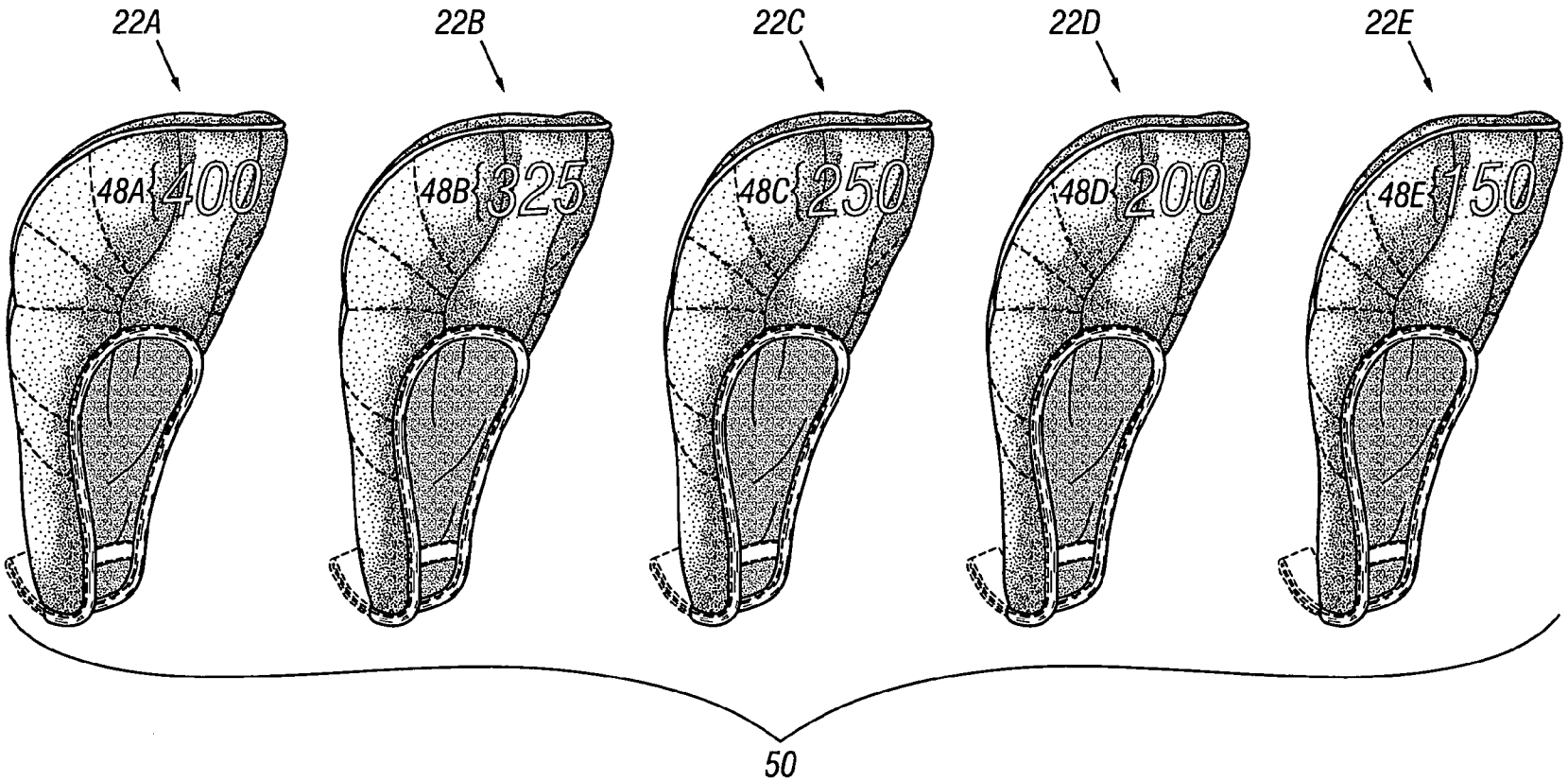
FIG. 13 is a perspective view of another embodiment of the present invention showing a set of golf club head covers of varying sizes.
Figure 14:
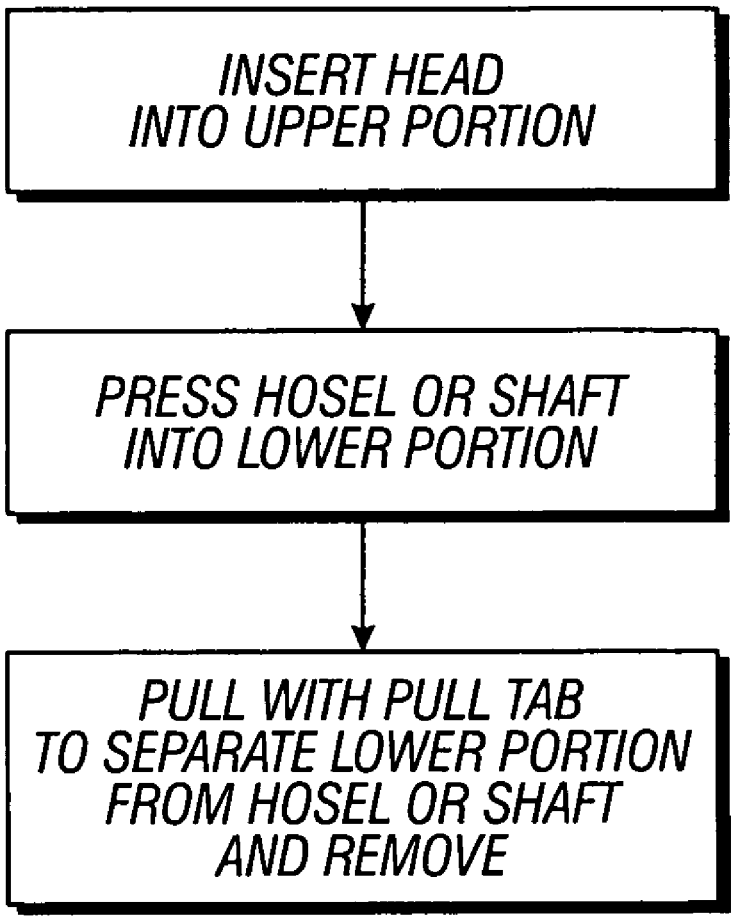
FIG. 14 is a flow diagram.

FIG. 13 provides a perspective view of a set 50 of golf club head covers. In FIG. 13, the golf club head covers are of various sizes. Golf club head cover 22A includes an identifier 48A of "400." Golf club head cover 22B includes an identifier 48B of "325." Golf club head cover 22C includes an identifier 48C of "250." Golf club head cover 22D includes an identifier 48D of "200." Golf club head cover 22E includes an identifier 48E of "150." As shown, each of these identifiers is related to a volume of the golf club head cover as measured in cubic centimeters. The present invention, however, contemplates, that other measurements of sizes and other measurements of volume can be used. The present invention contemplates that the golf club head covers can be sold individually, or in sets that contain a plurality of golf club head covers of different or same sizes. FIG. 14 shows one method for using the present invention.

From the foregoing it can be seen that the present invention contemplates numerous variations in the type of fastener if used, the location of the fastener, the shape of the fastener, the material used for the cover, the material used for the liner of the cover, the size of the golf club head cover, the identifier placed on the cover, if used, and other variations.

What is claimed is:

1. A golf club head cover for protecting the head of a club operatively connected to a shaft, comprising:

an integral body having an upper portion and a lower portion, the upper portion adapted for covering the head of the club;

the lower portion operatively connected to the upper portion for protecting a portion of the shaft of the club, the lower portion having an open collar configured for receiving the club head formed from spaced apart side walls; and a pair of opposing flaps attached to the collar that flex out of the way configured for inserting the head of the club into the upper portion and return to protect a portion of the shaft.

2. The golf club head cover of claim 1 further comprising a pull tab operatively connected to the body.

3. The golf club head cover of claim 1 further comprising a fastener operatively connected to the lower portion for securing the lower portion to the shaft.

4. The golf club head cover of claim 3 wherein the fastener is a clip.

5. The golf club head cover of claim 3 wherein the fastener includes a hook.

6. The golf club head cover of claim 3 wherein the fastener is a hook and loop fastener.

7. The golf club head cover of claim 1 wherein a first edge of the flaps attach to the upper portion and a second edge of the flaps attach to the lower portion.

8. The golf club head cover of claim 1 wherein the pair of flaps are fabric.

9. A golf club head cover for protecting a head of a club having a hosel and a shaft connected to the hosel, comprising:

an integral body having an upper portion and a lower portion, the upper portion adapted for protecting the head of the club, the lower portion adapted for protecting a portion of the hosel or shaft of the club;

the lower portion having spaced apart sidewalls forming an opening configured for receiving the head of the club; and a pair of opposing flaps attached to the upper portion and the sidewalls and located between the sidewalls and configured for protecting a portion of the shaft.

10. The golf club head cover of claim 9 wherein the spaced apart sidewalls taper closer together towards a bottom of the lower portion.

11. The golf club head cover of claim 9 wherein the lower portion is adapted for receiving the head of club.

12. The golf club head cover of claim 9 further comprising a tab operatively connected to the body.

13. The golf club head cover of claim 9 further comprising a fastener operatively connected to the lower portion for securing the lower portion to the shaft.

14. The golf club head cover of claim 13 wherein the fastener is a clip.

15. The golf club head cover of claim 13 wherein the fastener includes a hook.

16. The golf club head cover of claim 13 wherein the fastener includes hook and loop fasteners.

17. The golf club head cover of claim 9 wherein the flaps are flexible.

18. The golf club head cover of claim 9 wherein the flaps are fabric.

19. A golf club head cover, comprising:

a body adapted for receiving a golf club head;

an identifier attached to the body, the identifier indicating a size of the golf club head cover independent from a type of golf club; and a pair of opposing flaps attached to the body for protecting a portion of a shaft of the golf club.

* * * * *